US009759391B1

(12) United States Patent
Shew

(10) Patent No.: US 9,759,391 B1
(45) **Date of Patent: *Sep. 12, 2017**

(54) LED LIGHT FIXTURE ASSEMBLY

(71) Applicant: Larry N. Shew, White Lake, MI (US)

(72) Inventor: Larry N. Shew, White Lake, MI (US)

( * ) Notice: Subject to any disclaimer, the term of this patent is extended or adjusted under 35 U.S.C. 154(b) by 93 days.

This patent is subject to a terminal disclaimer.

(21) Appl. No.: 14/624,042

(22) Filed: Feb. 17, 2015

Related U.S. Application Data

(63) Continuation of application No. 13/802,187, filed on Mar. 13, 2013, now Pat. No. 8,956,013.

(51) Int. Cl.

| | |
|---|---|
| ***F21K 99/00*** | (2016.01) |
| ***F21S 4/00*** | (2016.01) |
| ***F21V 23/02*** | (2006.01) |
| ***F21S 8/02*** | (2006.01) |
| *F21Y 103/00* | (2016.01) |

(52) U.S. Cl.
CPC ..... *F21K 9/17* (2013.01); *F21S 4/008* (2013.01); *F21S 8/026* (2013.01); *F21V 23/023* (2013.01); *F21Y 2103/003* (2013.01)

(58) Field of Classification Search
CPC ..... F21S 4/00; F21S 2/005; F21S 4/28; F21S 9/02; F21S 4/20; F21S 6/00; F21S 8/00; F21S 9/00; F21V 23/023; F21V 15/01; F21V 23/006; F21Y 2101/00; F21Y 2103/10; F21Y 2105/10; F21Y 2115/10; G09F 9/33
See application file for complete search history.

(56) References Cited

U.S. PATENT DOCUMENTS

| | | | | |
|---|---|---|---|---|
| 2001/0015893 | A1* | 8/2001 | Campman | F21L 4/02 362/184 |
| 2006/0082988 | A1* | 4/2006 | Riblett | F21L 4/02 362/120 |
| 2011/0163672 | A1* | 7/2011 | Shew | H05B 33/0803 315/86 |
| 2013/0033195 | A1* | 2/2013 | Liao | F21S 9/032 315/294 |
| 2013/0099698 | A1* | 4/2013 | Podd | H05B 37/029 315/297 |

* cited by examiner

*Primary Examiner* — Hargobind S Sawhney
(74) *Attorney, Agent, or Firm* — L.C. Begin & Associates, PLLC

(57) ABSTRACT

A light assembly contains a housing. One or more LED light units are contained within the housing, wherein each of the LED light units may contain only one corresponding conductive end cap. A pair of conductors extending from each of the corresponding conductive end caps are mated with a corresponding socket contained within a DC power supply module contained within the housing.

11 Claims, 18 Drawing Sheets

A BLOCK DIRAGRAM IS SHOWN

LED LIGHT FIXTURE ASSEMBLY

This application is a continuation of co-pending U.S. application Ser. No. 13/802,187 having a filing date of Mar. 13, 2013, and claims the benefit thereof. This application is herein incorporated by reference in its entirety.

TECHNICAL FIELD

The present invention relates to light assemblies containing solid state lighting, and more particularly, to light assemblies incorporating a modular power supply, a light emitting diode (LED) light source within the housing of a new troffer/fixture. A light assembly, in accordance with the present invention, contains a modular power supply containing an AC to DC converter, and one or more socket holders mounted onto a circuit board of the power supply module as an exemplary means to receive a singular end cap of associated DC-operated LED light tubes. In further accordance with the present invention, a circuit board contains a modular design system containing modular components that facilitates easy removal and replacement of circuitry and other constituents.

BACKGROUND OF THE INVENTION

There are millions of fluorescent light tube troffers/fixtures installed every year, providing both task and general lighting within schools, offices, hospitals, and retail stores. Accordingly, the advent of the fluorescent light tube troffer/fixture has shown to be a significant improvement over incandescent light fixtures within the prior art.

The traditional fluorescent light tube troffer/fixture containing fluorescent light tubes and an electronic ballast have common drawbacks of high power consumption, short service life, and a somewhat fragile structure. Another drawback is their use of rare-earth and other toxic phosphors needed to generate light. This presents a problem when the tubes which have ceased to function require disposal. The phosphors within a fluorescent light tube may present a hazardous waste situation which must be dealt with.

There are a number of patents describing an LED base light source as one way to replace fluorescent light tubes. LED replacement tubes typically contain a transparent tube with LED's mounted inside the tube, and dual end caps, wherein each end cap is mounted at a respective end of the light tube. Both end caps each typically contain a pair of conductive prongs functioning as connectors so that the tube may be inserted into respective sockets within a fluorescent tube troffer, for example, thereby electronically communicating with the electronic ballast system of the fluorescent troffer. These LED replacement light tubes are therefore intended for retrofitting into an existing fluorescent light troffer/fixture. As such, the use of LED replacement light tubes within a new troffer/fixture would be one way of incorporating LEDs into new troffer/fixture, but it may be costly. One reason the LED replacement tubes cost more is the additional circuitry. For example, an AC to DC converter is typically incorporated within the tube increasing the cost of the LED replacement tube. Using known LED replacement tubes within a new or used troffer will also require conductive sockets at both ends of the troffer resulting in additional wiring and labor costs.

High bay fluorescent light fixtures are widely currently used as are the drop-in fluorescent troffers. The high bay fluorescent light fixture does not have a cover whereas the drop-in fluorescent troffers typically have a cover. Both types of troffers typically contain two to four fluorescent light tubes and are powered by a conventional fluorescent ballast. These fluorescent light tube fixtures/troffers have been used for decades. The exemplary two-foot by four-foot fluorescent light tube troffer is powered by AC energy and is activated by power from a wall switch. Light manufacturers, architects, and contractors are now oftentimes replacing the traditional fluorescent light troffer with a new troffer/fixture featuring LEDs as the preferred light source because of their longevity and relatively greater energy efficiency.

Another concern with the traditional fluorescent tube troffer is the complexity of its assembly. The fluorescent tube troffer requires an electronic ballast to power the fluorescent tubes and extensive wiring is required to connect the electronic ballast to the socket holders at both ends of the troffer resulting in a relatively higher overall cost.

Architects, homeowners, and contractors are therefore in need of a troffer/fixture similar in design, size and shape of a traditional fluorescent light tube fixture/troffer and offers LEDs as its light source. More importantly, a new troffer or fixture that provides power to operate a DC power LED light source (instead of the more expensive AC powered LED light tube replacement), reduces the replacement cost of the LED light source when the LEDs fails.

SUMMARY OF THE PRESENT INVENTION

In accordance with the present invention, an LED light fixture/troffer is provided containing one or more sockets holders or receptacles mounted on a circuit board of a power supply module and installed within a protective housing. In contrast to AC-powered LED replacement tubes, the present invention uses direct current as the power source to operate an LED light source containing only one end cap, costing less than an LED replacement tube that incorporates two end caps (one end cap at each end of the tube), and powered by AC energy.

The socket holders provide the connecting means with a corresponding number of "DC powered" LED light strips or LED light tubes. Alternatively, the present novel light fixture/troffer that incorporates a power supply module comprised with one or more socket holders and the means for operating a changeable DC powered LEDs light source may, if properly tailored, conceivably replace the conventional fluorescent light tubes troffer/fixture altogether with an LED lighting system that is more energy efficient, and more environmentally friendly.

The present invention provides substantial technical advantages and resolves the aforementioned concerns by simplifying the LED fixture/troffer with an LED lighting assembly having no interior wiring. The present invention eliminates the socket holders being located at both ends of the troffer/fixture, and replaces the known light tube assemblies receiving power from two end caps with a novel light assembly having LED arrays, strips, or bulbs that receive power from only one end cap. The present invention also incorporates an LED light tube or strip with that incorporates only one end cap instead of two. The single end cap with two prongs (a positive and negative) extending from the end cap provides the means to connect and receive DC powered to operate a LED light source.

The cost savings of not incorporating an AC to DC converter as part of the LED light source will result in lower manufacturing costs, thereby making replacement of a failed LED light source less expensive to the consumer.

In accordance with the present invention, a light assembly may contain a modular designed system providing the means to add additional functions, and the ability to remove and replace failed circuitry.

A first embodiment of the present invention may contain a new troffer/light assembly that may contain a motion sensor. Using the motion sensor, the power supply module may be configured to transition between an active state and an inactive state. In the inactive state, the power supply module reduces the brightness of or turns off some or all of the light emitting diodes. Or, the power supply module may be configured to enter an active state upon detection of motion using the motion sensor, and to enter an inactive state after a predetermined period of time after the last detection of motion by the motion sensor.

A second embodiment of the present invention may contain a new troffer/light assembly that may contain a backup power system that includes one or more batteries and a battery charger to provide power to one or more light emitting diode and actuated when the AC power is interrupted.

A third embodiment of the present invention may also contain a new troffer/light assembly that may contain a night lighting system. Using a photosensor to electronically communicate with said power supply module, wherein the photosensor detects bright light, the power supply module may adjust the output of the light emitting diodes. In some instances, it may be desirable to dim the LED light source when bright light is detected, thus reducing energy consumption when not needed. Furthermore, it may be desirable to communicate with at least one light emitting diode for actuation during an absence or mitigation of ambient light, whereby a photovoltaic cell may be provided to electronically communicate with the light emitting diodes of the device.

A fourth embodiment of the present invention may contain a new troffer/light fixture assembly that may further contain a remote control sensor. Using the remote control sensor, the power supply module may be configured to perform various functions in response to signals received by the remote control sensor. These functions may include disabling at least one of the light emitting diodes, and/or changing the level of brightness of the LED light source. The light assembly may be programmed to periodically turn on or off at a certain time(s), and/or to switch the LEDs to night lighting by reducing the level of light.

The present invention may further include a troffer containing one or more socket holders receptacles mounted onto a circuit board of a power supply module for receipt of a tube or strip or LED lighting device containing the singularly conductive end cap. The circuit board may be inserted within a protective housing for the purpose of providing DC power to one or more replaceable, singular conductive end cap LED light strips or tubes.

In yet a further fifth embodiment of the present invention, a power supply module may function in a similar fashion as the fourth aforementioned embodiment, but may be designed to be retrofitted within an existing fluorescent light tube troffer.

A sixth embodiment of the present invention may include a physically expandable power supply module that fits within a one-sided or two-sided sign normally found along the road. Other features and aspects of the invention will become apparent from the following detailed description, taken in conjunction with the accompanying drawings, which illustrate, by way of example, the features in accordance with embodiments of the invention.

Accordingly, the present invention uses direct current as the power source to operate an LED light source containing only one end cap, costing less than an LED replacement tube that incorporates two end caps (one end cap at each end of the tube), that is powered by AC energy.

DETAILED DESCRIPTION OF THE INVENTION

It is therefore a primary objective of the present invention to resolve the issues facing the traditional fluorescent light tube troffer/fixture and overcome the drawbacks by providing an LED light assembly within a new troffer/fixture, or as a retrofit subassembly within an existing fluorescent troffer, as a better solution.

Figure 1:
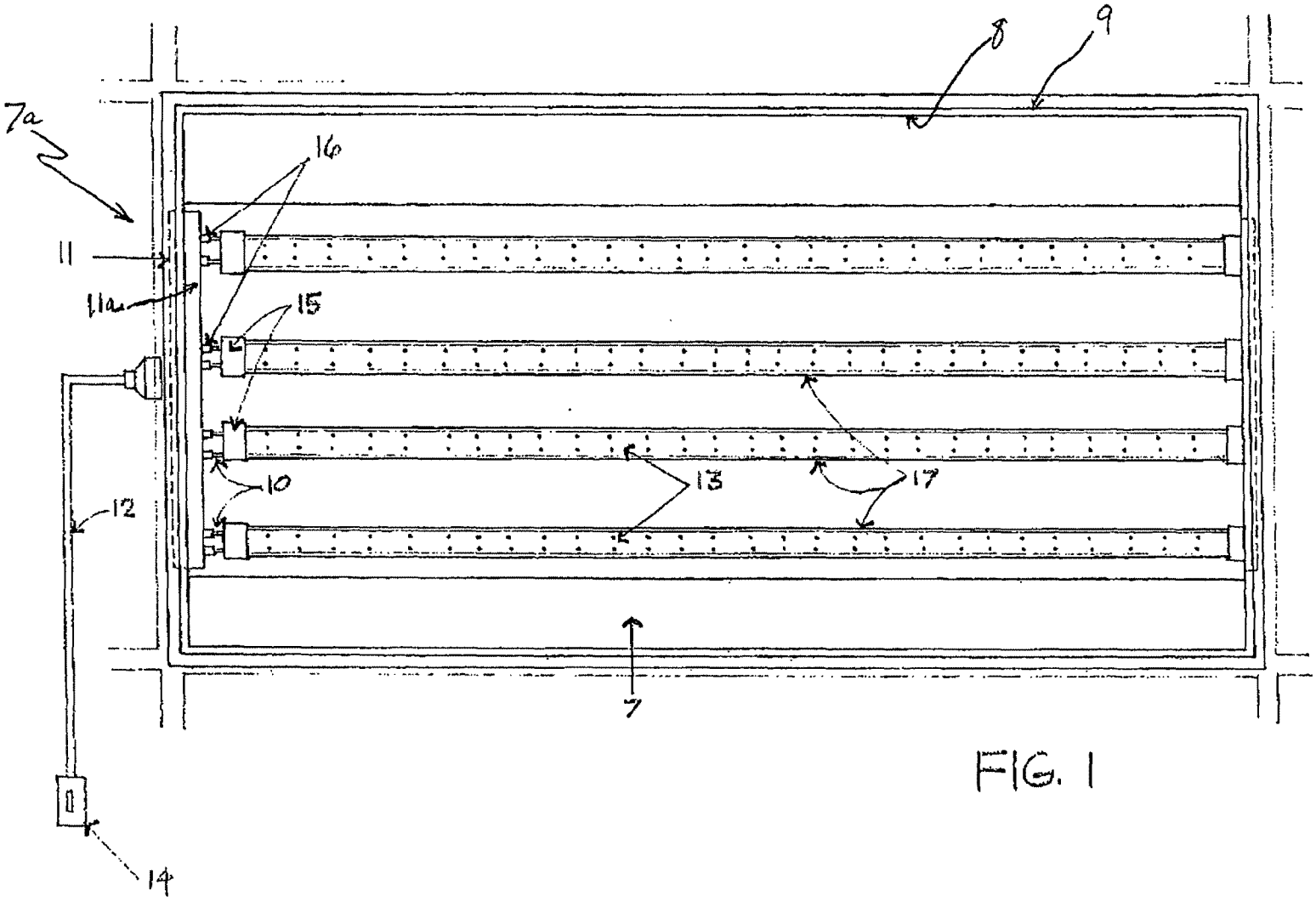
FIG. 1 illustrates a view of conventional troffer with a transparent door cover, representing a first embodiment of an LED light assembly in accordance with the present invention, wherein the light assembly/troffer may be installed within a dropped ceiling.

A first embodiment of an LED lighting assembly in accordance with the present invention is illustrated in FIG. 1. A troffer/fixture 7 may contain a housing 8 and translucent or transparent cover 9, and is normally installed within an office or industrial setting, or within a suspended ceiling for example. A power supply module 11 is slidably and releasably fixed within an end section 7*a* of the troffer 7, for providing a source of direct current or DC power to associated LED assemblies such as strips or tubes. An AC or alternating current power source 12 electronically communicates with the module 11, thereby providing AC power for conversion into DC power within module 11. The DC power electronically communicates with an LED light source 17 by and through a singular conductive end cap on the LED light source 17. In accordance with the present invention, the power supply module 11 contains all internal circuitry necessary to provide DC power to the LED light assemblies 17 as described below, and may be manufactured from internal circuitry as known in the art. U.S. Pat. No. 6,936,968, herein incorporated by reference in its entirety, exemplifies but does not limit the various circuitries that could be employed to accommodate the one-endcap system.

A circuit board 11*a* of the power supply module 11 is contained within a protective sub-housing or cover 7*c*, and is installed at one end 7*a* of the new troffer 7. As shown in FIG. 1, one or more socket holders (receptacles) 16 are mounted directly to a circuit board of the power supply module 11 as the means to connect and communicate DC power from the power supply module 11 to one or more LED light sources 17. As also shown in FIG. 1, a troffer/fixture 7 of the present invention may, although not necessarily so limited, contain similar dimensions and the shape of a conventional fluorescent light tube troffer/fixture. As also shown in FIG. 1, an LED light source 17 may if desired feature the same dimensions as that of a conventional fluorescent light tube and is mounted on one side of a circuit board 11*a* for electronic communication therewith. In this way, LEDs 13 provided in series or other electronic configuration within the LED light source 17 may be illuminated by DC power received from the circuit board 11*a*. As also shown in FIG. 1, each LED light source 17 contains only one end cap 15, each end cap preferably containing a pair of conductive prongs 10.

Figure 2:
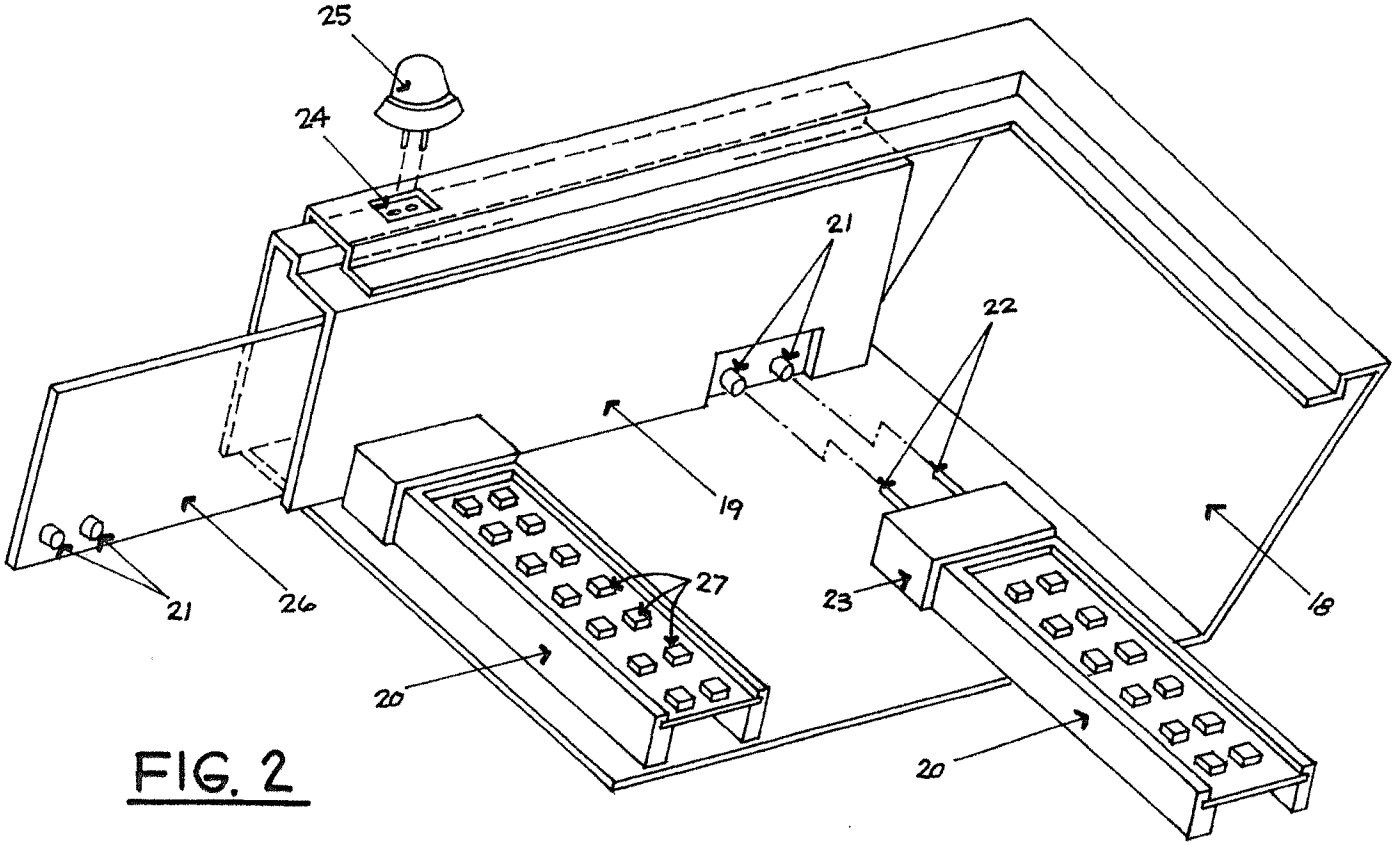
FIG. 2 illustrates a perspective view of an embodiment of the present invention within a conventional troffer, containing a modular power supply at one end of the troffer, and LEDs as a light source, in accordance with the present invention.

FIG. 2 illustrates another embodiment with a perspective view of the troffer 18, the power supply module 19 and an LED light source 20. As with the first embodiment, the troffer 18 may feature a transparent cover (not shown), allowing the light from the LEDs to shine therethrough, but it may also function as a cover over the power supply module 19. The door or cover provides protection to the power supply module 11 and at the same time it provides easy access to remove and replace any circuitry that fails. FIG. 2 also illustrates openings 24 within the door cover to allow for adding a motion sensor 25 to activate the light when motion is detected or a photocell to be exposed and the means to activate a limited number of LEDs at night (night lighting). FIG. 2 also illustrates a pair of receptacles 21 (one positive, one negative) corresponding with an end cap 23 having a pair of extending prongs 22 as connectors of the elongated LED light source 20. The power supply module 19 is connected to alternating current that may be directly provided by a continuous circuit from a service and/or controlled by a remote switch (not shown). The present invention not only facilitates convenient installation, maintenance, and repair, but also lowers the manufacturing and application cost of the LED light source. Additionally, the present invention provides the benefit of a simple method of removing and replacing damaged or burned-out LEDs at a reduced cost.

FIG. 2 illustrates an LED light source in the form of an elongate LED strip 20 or tube in accordance with the present invention. The LED strip 20 may have the same dimension as that of a fluorescent light tube and contains a circuit board having one or more LEDs 27 mounted on one side in series, parallel, or other electronic configuration, and is powered by DC power running through only one end cap 23 similar to the embodiment of FIG. 1

Figure 3:
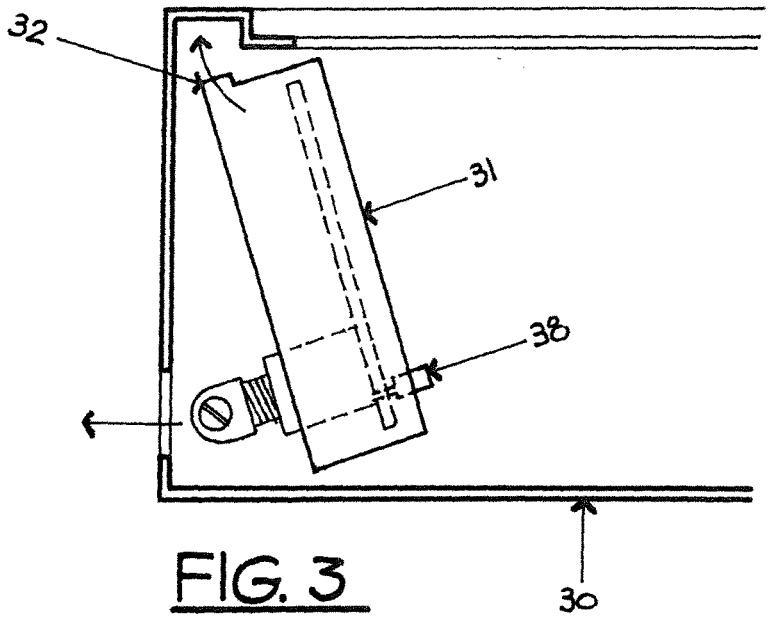
FIG. 3 illustrates a cross-section of the first embodiment taken through the end of a conventional troffer, whereby the modular power supply is slidably and releasably secured into a position within the troffer, in accordance with the present invention.

FIG. 3 illustrates a section detail through the end 30*a* of a troffer 30 whereby the power supply module 31 slidingly engages an end enclosure 30*d* thereby removably seating the power supply module within the troffer 30. FIG. 3 illustrates an example of a power supply module 31, designed with a special projection 32 that allows the module to lock in place through mating with a complimentary slot 32*b* within the troffer 30, for example.

Figure 4:
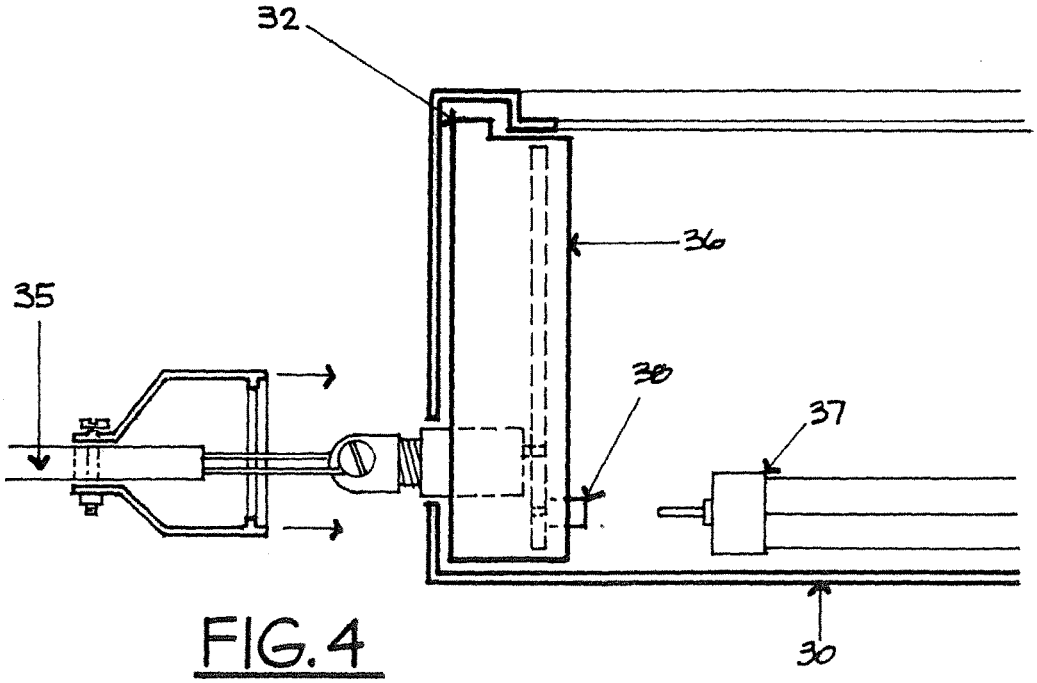
FIG. 4 illustrates an end section of the troffer and a modular power supply with socket holders mounted on one side of a circuit board as the means to connect to an LED light source and an AC source, the AC source in electronic communication with the modular power supply, in accordance with the present invention.

FIG. 4 illustrates the alternating current 35 being connected to the rear panel 36*a* of the power supply module 36 as the means to electronically communicate with AC power source 35. Mounted on the circuit board 34 of the power supply module is an AC/DC converter (not shown) configured to direct DC energy to each socket holder 38, thereby providing the power to operate an LED light source 37 by way of the socket holders 38. It will be appreciated that a special dimming switch (not shown) may be selectively operated to dim the power to one or more LED light sources 37 resulting in different levels of light.

Figure 5:
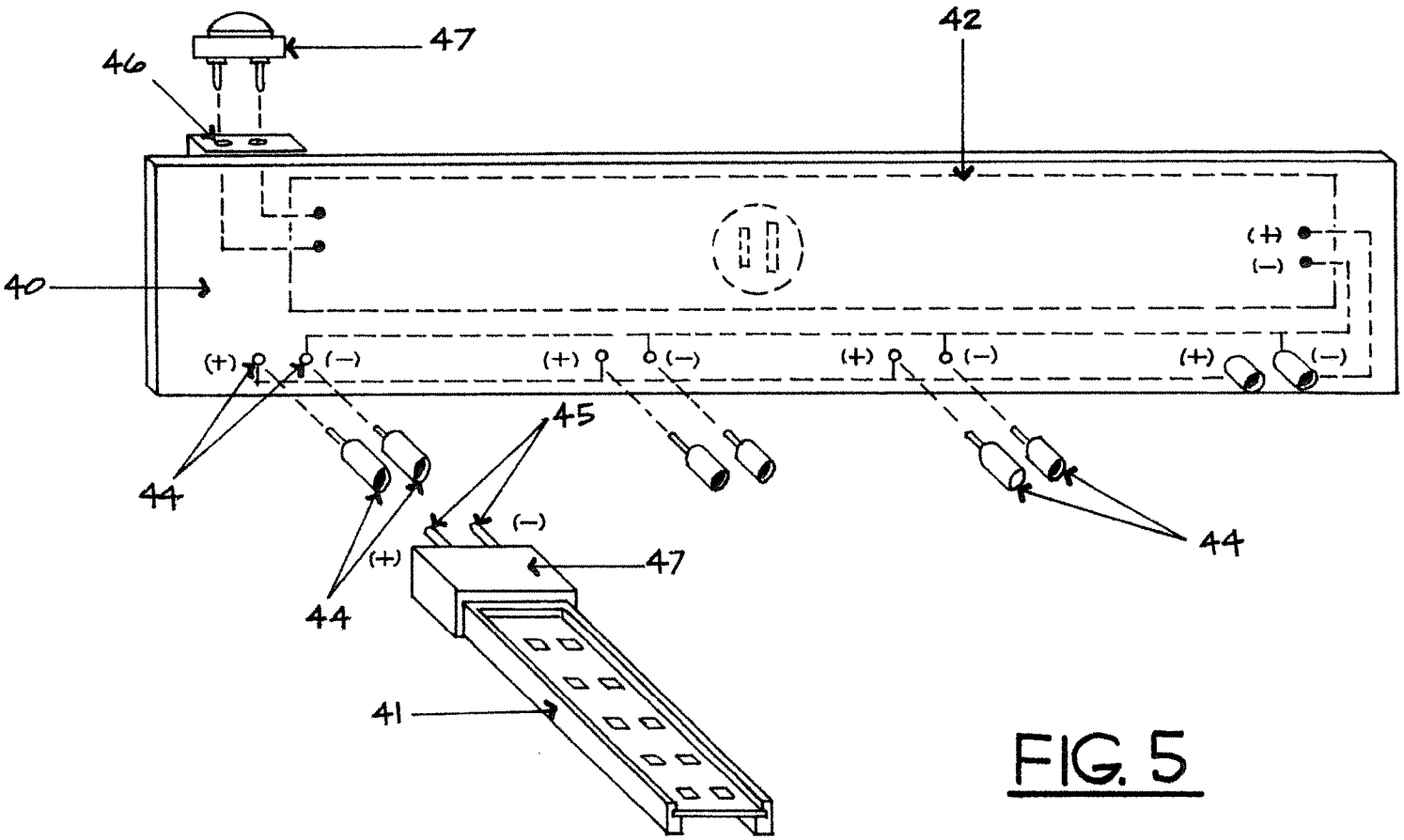
FIG. 5 illustrates a plan view of the circuit board of the modular power supply. The circuit board is comprised of one or more socket holders, an AC to DC convertor, and an LED light source in accordance with the present invention.

FIG. 5 schematically illustrates a circuit board 40 of the power supply module of the first embodiment in accordance with the present invention. The circuit board 40 is comprised of a single AC/DC converter 42 as the means to power several LED light sources 41. One or more pairs of receptacles 44, four pairs of receptacles 44 (each pair having one positive and one negative prong), are mounted onto the circuit board 40 to provide DC power to an LED light source. A single end cap 47 contains conductive prongs 45 that electronically communicate with receptacles 44 and with the DC potential delivered by receptacles 44 thereby illuminating the associated LEDs. If desired, a pair of receptacles 46 may be mounted on top of the circuit board 40 for installing a motion sensor 47.

Figure 6:
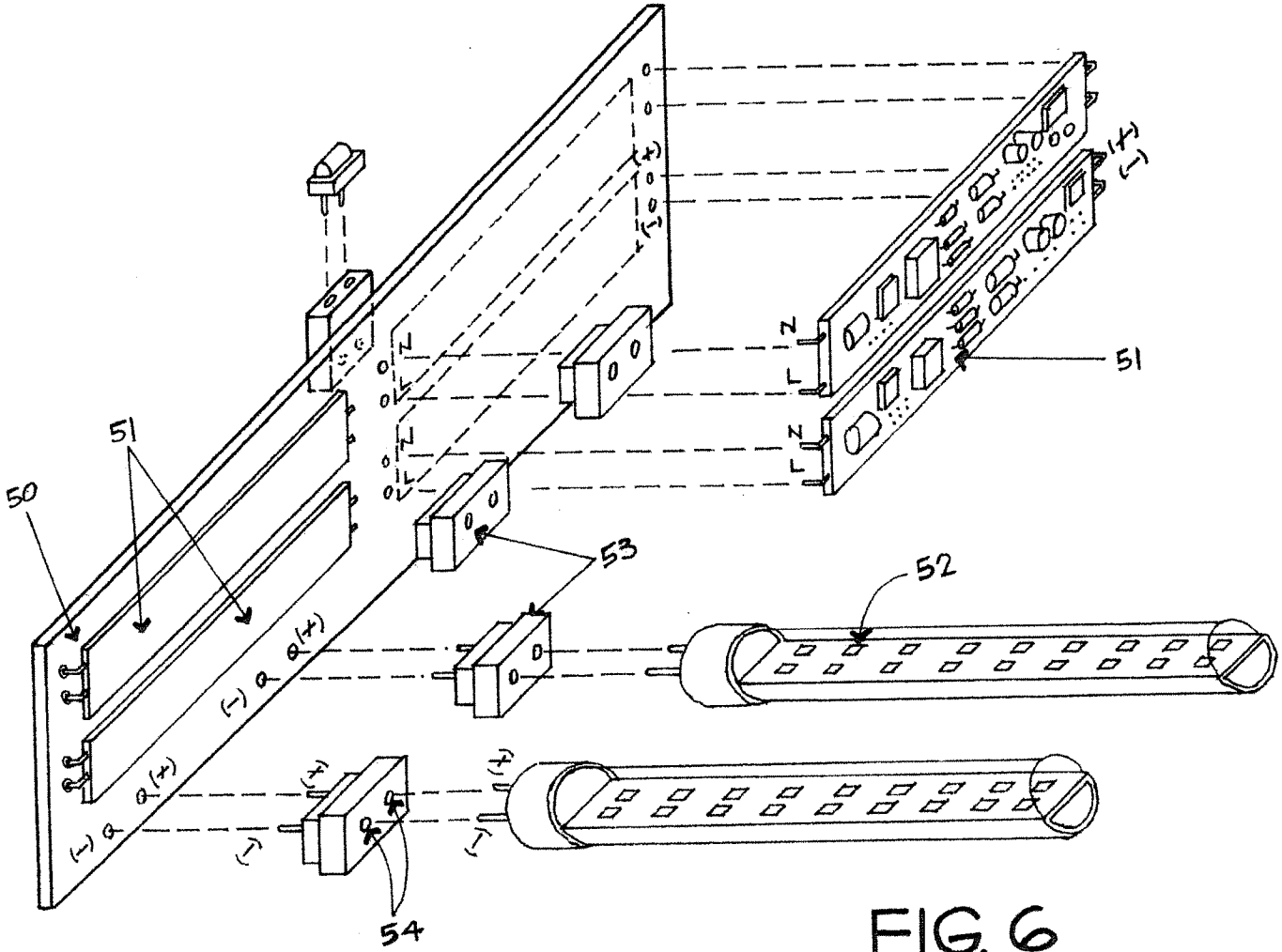
FIG. 6 illustrates a perspective view of the first embodiment including the circuit board of the modular power supply and its modular design system in accordance with the present invention. As schematically shown, the tubes or strips are independently operable of each other, in accordance with the present invention.

The embodiment illustrated in FIG. 6 is functionally the same as FIG. 5, and yet provides an advantage not heretofore seen. In accordance with yet another aspect of the invention, the circuit board 50 is defined by a modular design system that allows the changing of any circuitry or part if it ever fails. As shown in FIG. 6, four removable or changeable AC/DC converters 53 contain a pair of female receptacles 54. Four corresponding pairs of conductive prongs 55 (one positive and one negative) are attached to four LED light tubes 52 and when each pair of conductive prongs 55 are seated within a corresponding pair of female receptacles 54, a DC potential provided by the respective converter 53 operatively communicates with the LEDs within the LED light tube shown. In contrast to the embodiment shown in FIG. 5 having only one AC/DC converter or rectifier, each converter or rectifier 53 and its operative circuitry as schematically represented by each modular circuit board 51, is operatively independent of the other three converters 53, thereby enhancing the reliability of the light assembly. Stated another way, and in contrast to many state of the art LED light assemblies, when one driver 53 or LED light tube 52 fails, the remaining tubes 52 remain illuminated thereby providing light even when one or more tubes fail. It will be appreciated that a simple replacement of the modular board 51 relating to the respective failed LED light unit 52 will again restore lighting for the affected LED bulb 52. It will be further appreciated that the modularity of the lighting assembly shown in FIG. 6 results in the consumer's ability to replace only the defective component, as opposed to replacing a complete LED light bulb as was their choice in the past. Again, prior art LED replacement tubes contain a rectifier or AC/DC converter and the lighting circuitry. This therefore necessitates replacement of the entire lighting unit rather than just a component thereof. FIG. 6 also illustrates yet another example of the socket holders 53 mounted onto a circuit board 50 of a modular power supply as the means to electrically communicate with an LED light tube 52. The power supply module with its modular design system is adapted to permit a consumer to optionally remove and replace the attendant circuitry with upgrades or additional circuitry (not shown) as the means to add additional lighting functions, for example.

Figure 7:
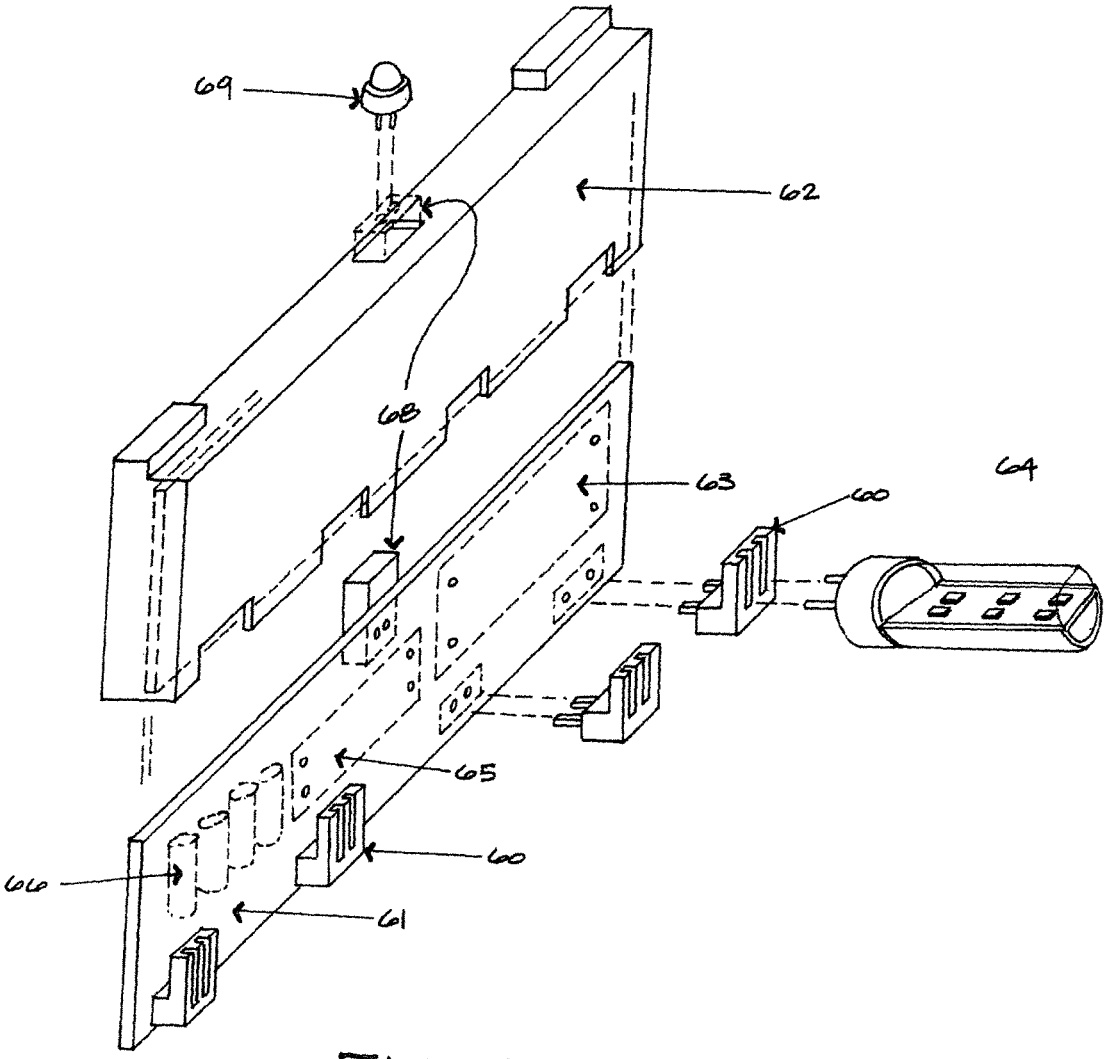
FIG. 7 illustrates an exploded view of a circuit board of the modular power supply and the cover or sub-housing that protects the modular power supply in accordance with the present invention.

FIG. 7 illustrates yet another embodiment containing an example of a plurality of socket holders 60 mounted onto the circuit board 61 of a power supply module. The circuit board 61 is inserted or encased within a protective housing 62. As with the other embodiments, an AC/DC converter 63 is contained within the circuit board 61 whereby the converter 63 electronically communicates with the LED light source(s) 64 as the means to convert the incoming AC power to DC power to operate several LED light sources 64. FIG. 7 also illustrates an embodiment of the power supply module that contains an emergency lighting system which includes a battery charger 65, and one or more batteries 66 (preferably lithium rechargeable batteries). When a power outage is detected, the emergency light system is activated, switching the power source to the backup batteries 66 as the means to power one or more LED light tubes 64. A test circuit (not shown) may be provided on the outer housing to provide convenient testing of the emergency lighting circuitry. On the rear panel (not shown) of the housing or cover 62 is an elongated opening providing the venting means to release heat generated from the circuitry within the housing. FIG. 7 illustrates a pair of receptacles 68 at the top of the circuit board for inserting a motion sensor 69 and a means to switch on the LED light source 64 when someone enters the room or to deactivate or turn off the light assembly when no motion is detected.

Figure 8:
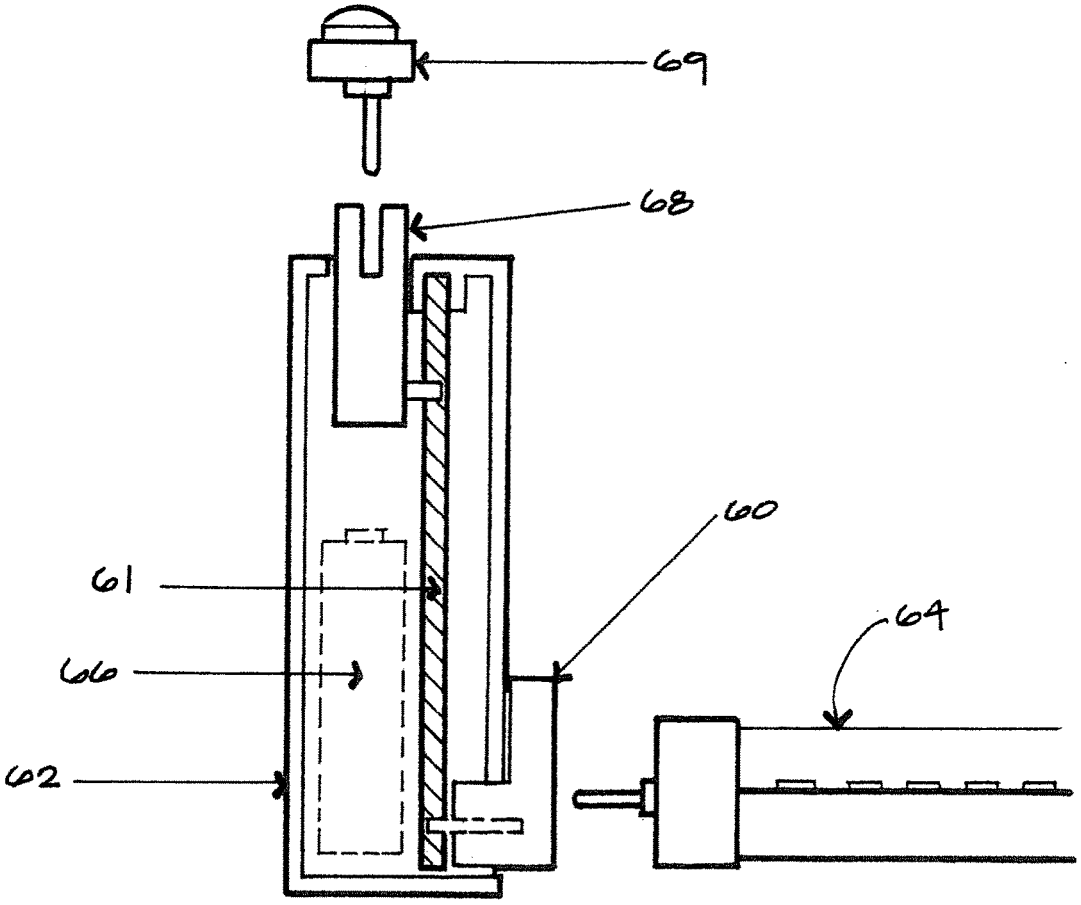
FIG. 8 illustrates the first embodiment a section detail of the modular power supply and a LED light source in accordance with the present invention.

FIG. 8 illustrates a section detail of FIG. 7 containing an AC to DC converter (not shown), a socket holder 60 mounted onto a circuit board 61, a pair of receptacles 68 to receive a motion sensor 69 and batteries 66 assembled within a protective housing 62.

Figure 9:
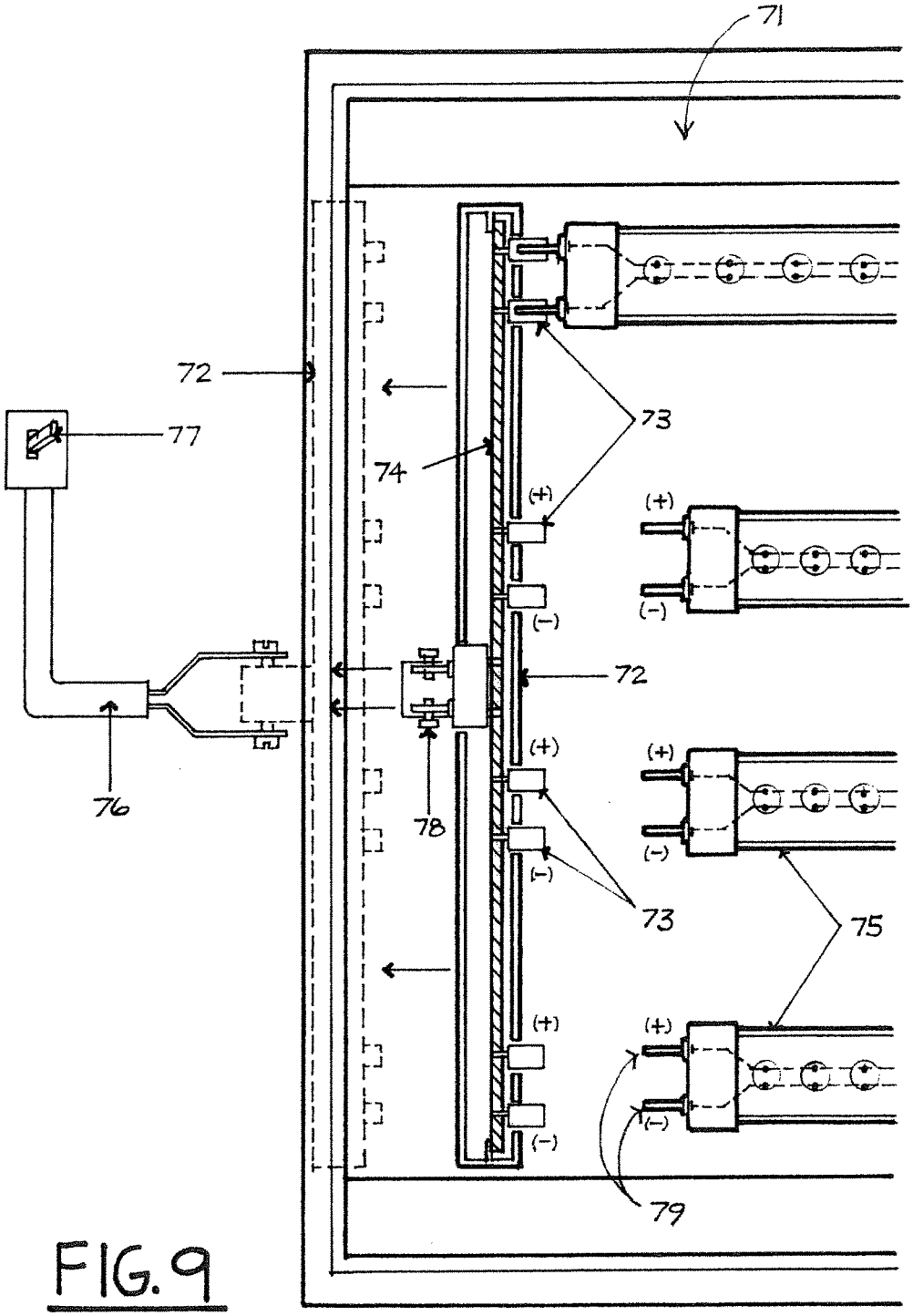
FIG. 9 illustrates a top view of one embodiment taken through a cross section of the modular power supply, the power supply containing an AC connection, and an LED light source (in a form of a light tube with only one end cap) in accordance with the present invention.

FIG. 9 illustrates a top view of a troffer 71 and a section detail of the power supply module 72. FIG. 9 illustrates four pairs of female receptacle 73, one positive and one negative, mounted onto a circuit board 74 and installed within a protective housing 72. The circuit board 74 of the power supply module may be configured to receive AC power 76 within the troffer/fixture 71 and activated by a wall switch 77. It will be appreciated that as with all of the embodiments presented, the power supply module 70 operates one or more LED light sources 75 within the new troffer/fixture 71.

Figure 10:
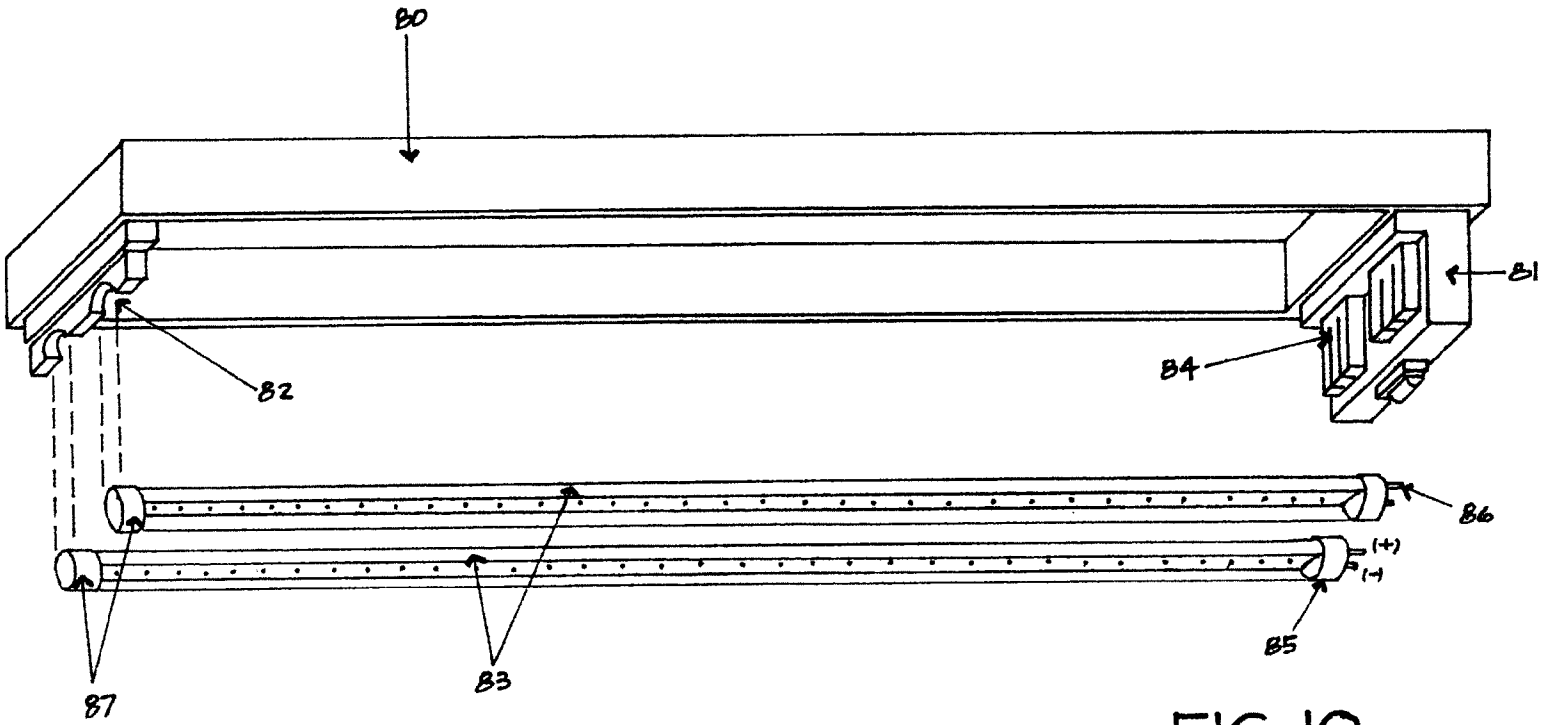
FIG. 10 illustrates a perspective view of a second embodiment containing an LED fixture and two LED light tubes in accordance with the present invention.

FIG. 10 illustrates yet another embodiment 80 of the present invention, similar in operation, size, shape, and look of a "high bay fluorescent light tube fixture". Stated another way, in accordance with the present invention, an LED light assembly 80 contains an open troffer (no cover) or strip fixture. It will be appreciated that the operable circuitry of this embodiment may be similar to the embodiments of FIGS. 5 and 6, for example. Normally this type of fixture is used within areas of high ceilings. In order to provide further efficiency within the present invention, some form of reflective coating that may contain white, silver, or other color paint, for example, is disposed internally to help improve reflecting the light source within the strip fixture. Equally important, the addition of angle sides (not shown) to help redirects the light downward, thereby resulting in maximize light output efficiency. FIG. 10 illustrates an exploded view of the second embodiment of the present invention containing a power supply module 81 at one end of the strip fixture and a support bracket 82 at the opposite end as the means to hold an LED light tube(s) 83 within the fixture 80. The power supply module 81 illustrated in FIG. 10 may also function in the same way as the first embodiment, incorporating the same modular design system, and having the same ability to add additional functions. The power supply module 81 illustrated in FIG. 10 also features the benefit of being able to remove and replace any failed circuitry. FIG. 10 schematically illustrates a circuit board contained within power module 81, containing an AC to DC converter, and socket holders 84 as means for connecting and providing DC power to one or more LEDs light tubes 83. As also shown in FIG. 10, end caps 85 contain a respective pair of conductive prongs 86 for seating within sockets 84 for receipt of DC power from the power module 81.

Figure 11:
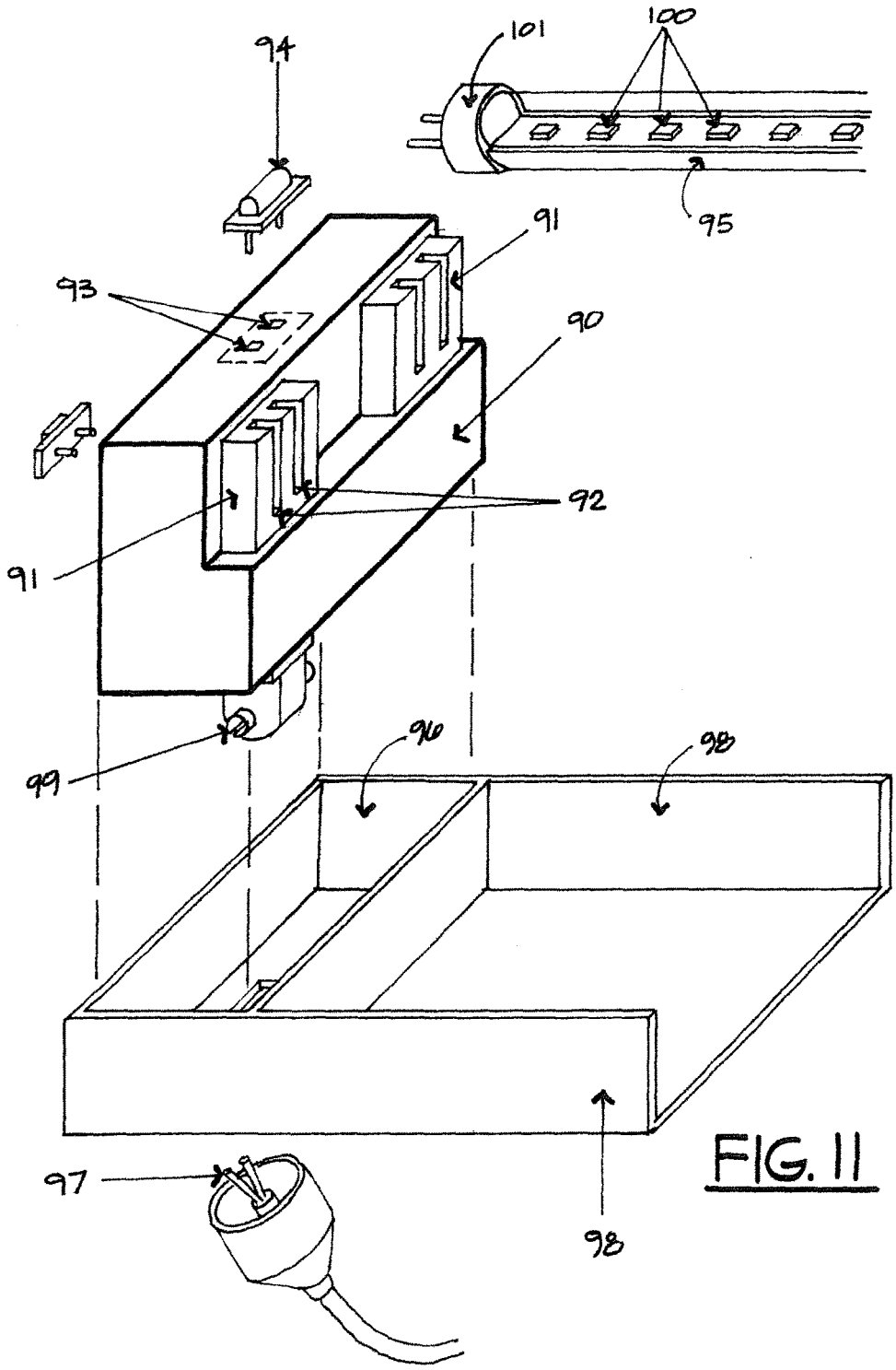
FIG. 11 illustrates a perspective view of the modular power supply being inserted into the end of the strip fixture in accordance with the present invention.

FIG. 11 schematically illustrates a perspective view of yet another embodiment or light assembly 110. A DC power supply module 90 contains two socket holders 91 as the means to connect and deliver DC power to one or more LED light tubes 92. Within the housing of the power supply module 90 is an AC/DC converter (not shown) mounted onto a circuit board (not shown) as the means to provide DC power to operate the two LED light tubes 92. Located at the top of the housing and mounted directly to the circuit board (not shown) of the power supply module is a pair of receptacles 93 for installing a motion sensor 94 to function as a switch to turn on the LED light tube when motion is detected and turn of when motion is not detected. The power supply module 90 is seated within or fits within a compartment 96 of an open frame fixture 98 (commonly known as a strip fixture) upon assembly of the light assembly 110.

Located at the bottom of the power supply module is a AC connection 99 as the means to connect and receive AC power source 97. The LED light tube 92 is comprised of one or more LEDs 100 mounted onto a circuit board having only one cap 101 with a pair of prongs 102 (one positive, one negative) extending outwardly as the means to connect and receive DC power from one or more socket holders 91.

Figure 12:
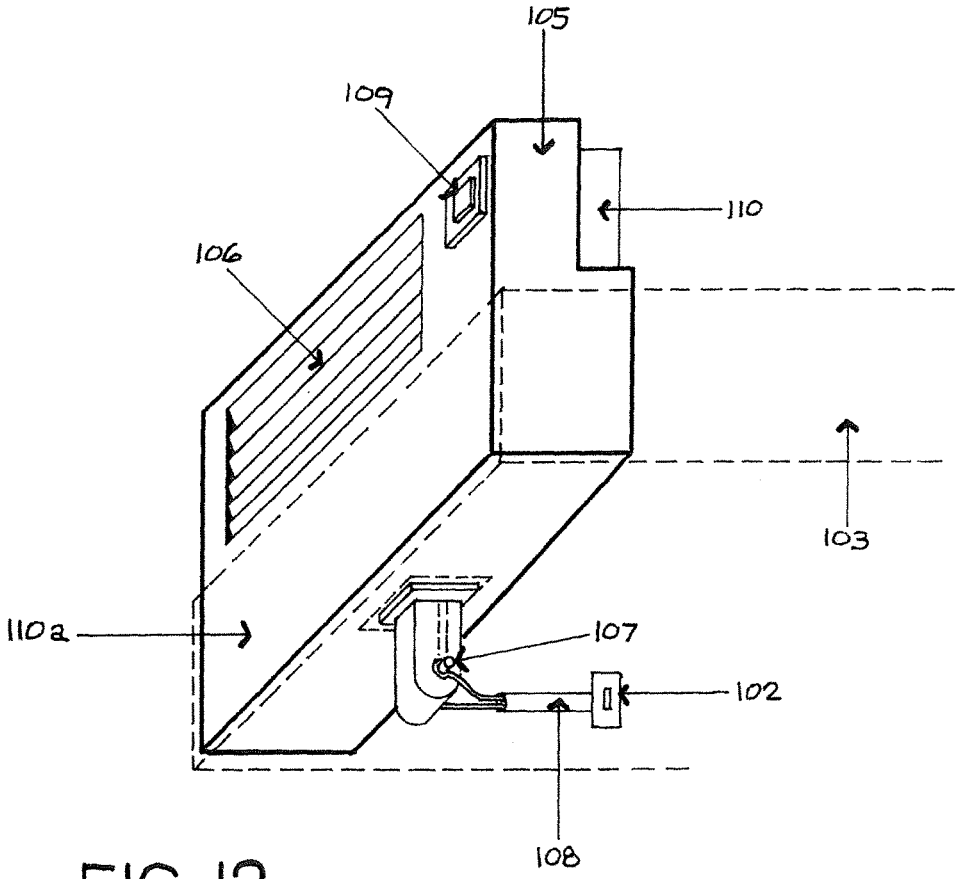
FIG. 12 illustrates a perspective view of the back side of a modular power supply of an embodiment in accordance with the present invention.

FIG. 12 illustrates a perspective view of the rear panel of an embodiment 110, similar to the one shown in FIG. 11. A power supply module 105 contains an elongated vent 106 to vent heat generated by the circuitry within the associated housing 110*a*. Reducing the heat keeps the temperature around the circuitry relatively lower, with a resultant increase in the longevity and efficiency of the circuitry. A connector or plug 107 located at the bottom of the power supply module housing 110*a* connects an AC power source 108 to the assembly 110. If desired, a switch 102 may cooperate with AC power source 108 for selectively actuating power to the assembly 110. FIG. 12 also illustrates a photocell switch 109, mounted on the rear panel 105*a* of the power supply module 105, and in a known manner, selectively actuates power to a limited number of LEDs as a night light in the absence or attenuation of ambient light. A motion sensor (not shown) may also be mounted on the top side of the power supply module as the means to detect motion within a space and act as a switch, switching on the LED light tubes when motion is detected.

Figure 13:
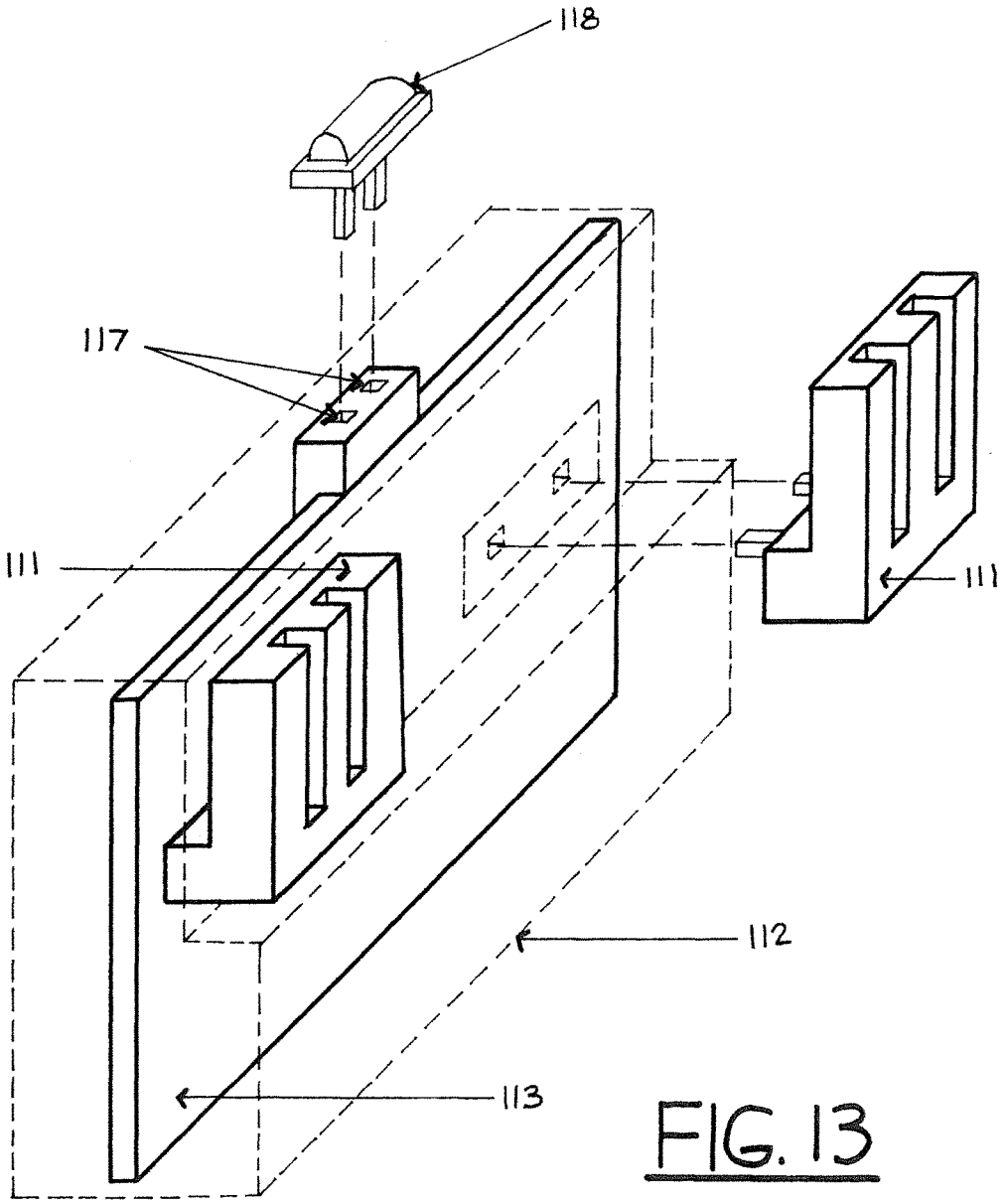
FIG. 13 illustrates an exploded view of yet another embodiment, and a schematic view of the circuit board with socket holders, an AC to DC converter, and a motion sensor in accordance with the present invention.

FIG. 13 illustrates yet another embodiment wherein the circuit board 113 of a power supply module 112 contains two socket holders 111 as the means to connect DC power to an LED light tube 115, thereby operating the LED light tube 115.

Figure 14:
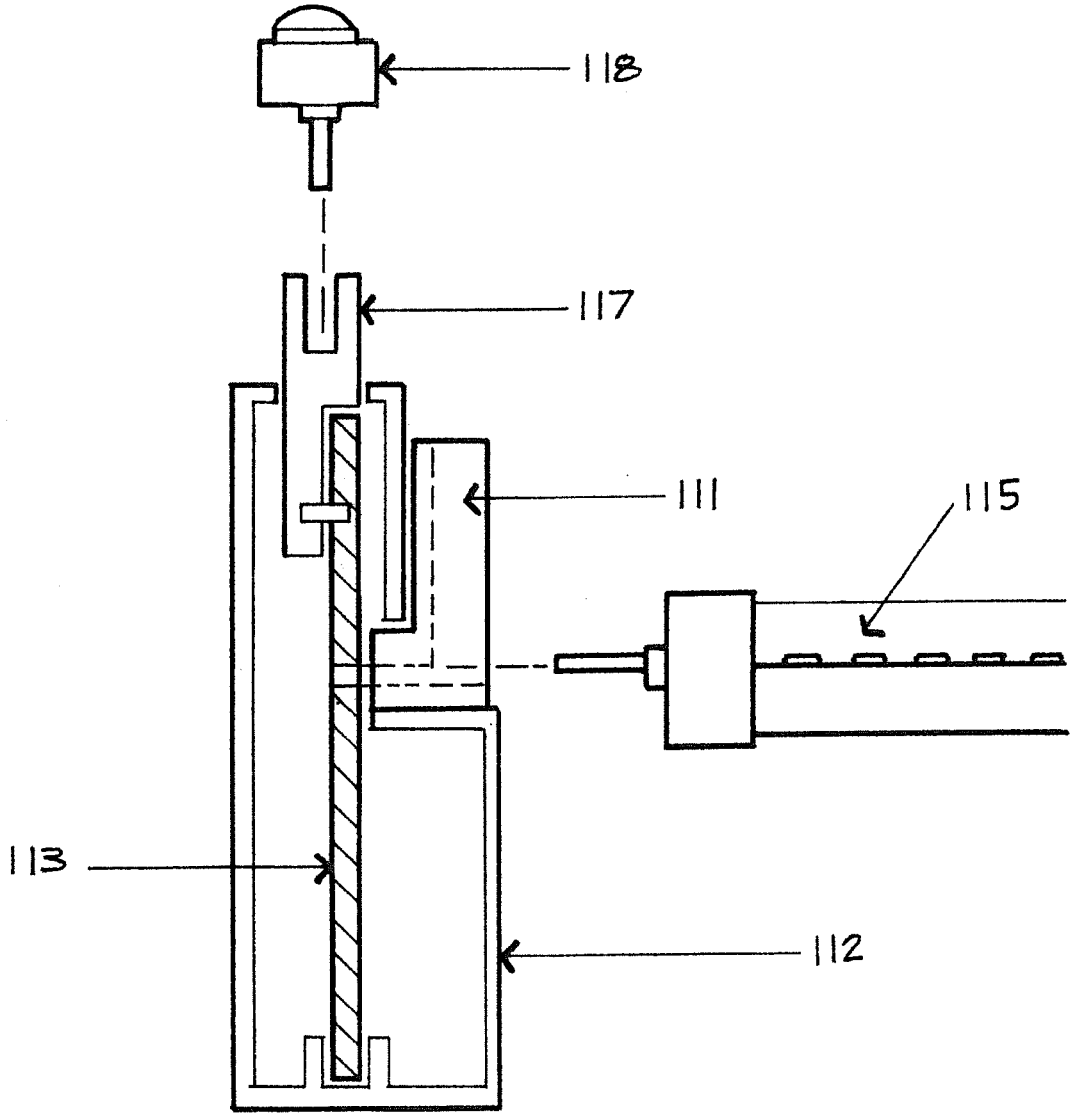
FIG. 14 illustrates a cross section view taken through the second embodiment circuit board and the sub-housing/cover that protects it, in accordance with the present invention.

FIG. 14 illustrates a section detail of FIG. 13, wherein the power supply module 112 contains a circuit board 113, socket holders 111 (to connect and deliver DC power to a LED light source 115), and an AC/DC converter (not shown) installed within a protective housing 110*a*. Also illustrated in FIG. 13 and FIG. 14 at the top of the modular power supply are a pair of receptacles 117 to receive a motion sensor 118 as the means to switch on a LED light source 115 when motion is detected and off when no motion is detected.

Figure 15:
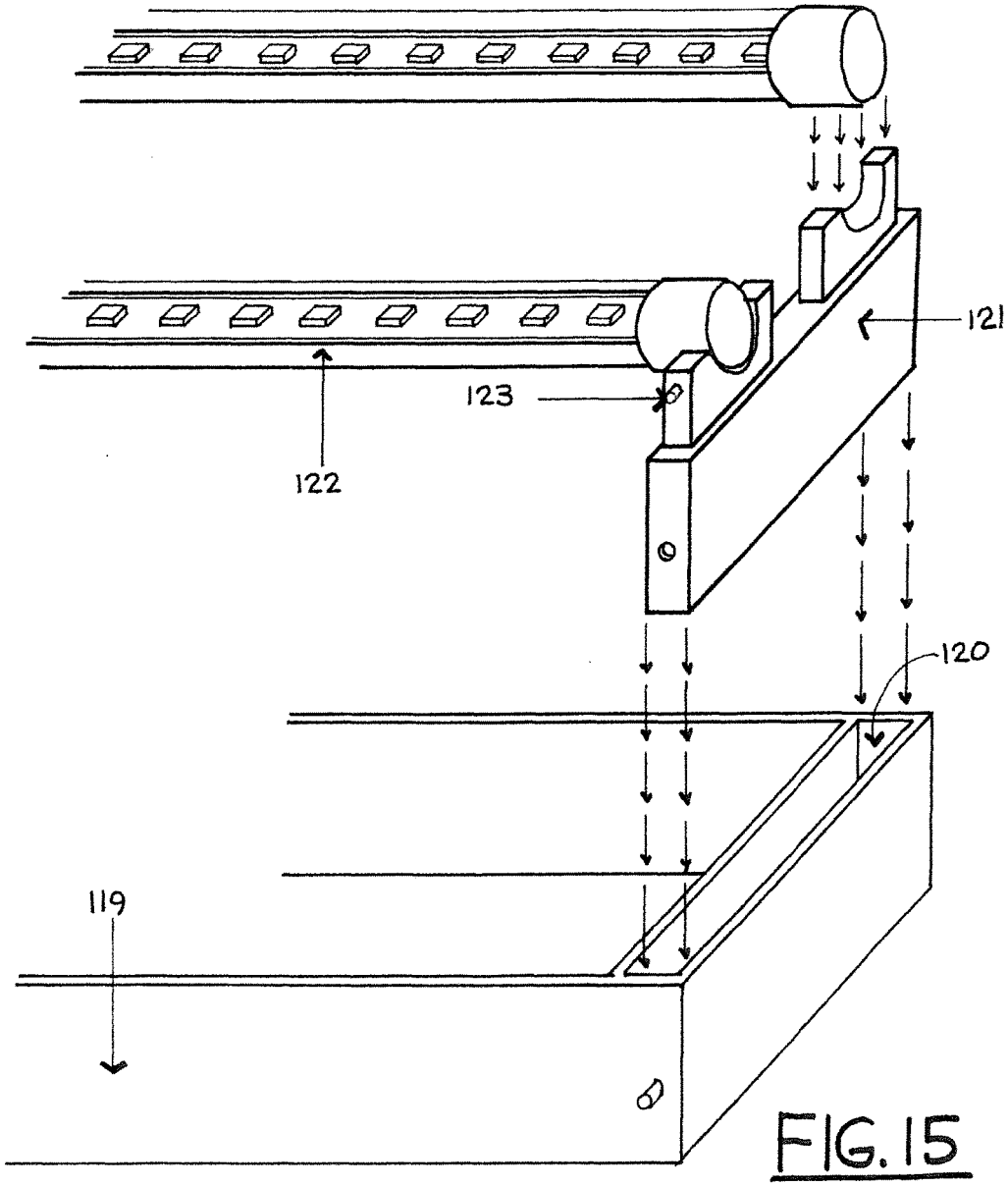
FIG. 15 illustrates a perspective view of the support bracket at the end of the strip fixture that holds the LED light tubes in place in accordance with the present invention.

FIG. 15 is a perspective view of an opposite end of a strip fixture 119 containing a compartment 120 to install a support bracket 121. The support bracket may contain a locking pin 123 to hold an LED light tube 122 within the strip fixture 119, and functions to hold the non-conductive end 124 of the tubes 122.

Figure 16:
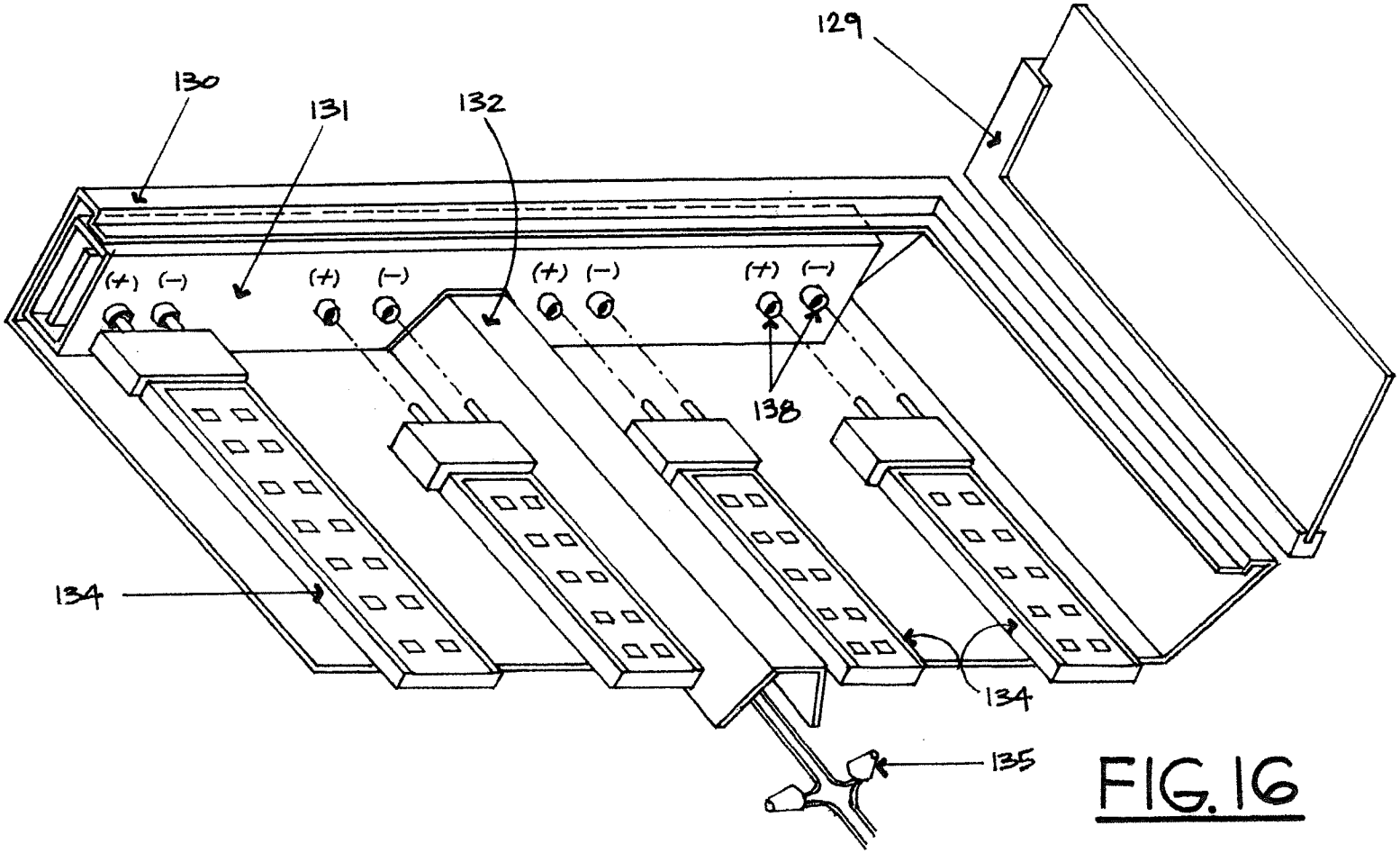
FIG. 16 illustrates yet a third embodiment and a perspective view of a retrofit modular power supply within an existing fluorescent light tube troffer, in accordance with the present invention.

FIG. 16 illustrates another aspect of the invention of the power supply module sized and shaped to be retrofitted within an existing fluorescent light tube troffer. It will be appreciated that the interest in retrofitting existing fluorescent light tube troffers/fixtures is increasing as more and more owners are converting their existing fixtures from fluorescent fixtures to LED fixtures. It will also be appreciated that the functionality of the retrofit power supply module 131 is essentially equivalent as of that in the embodiments shown in FIG. 1 through FIG. 15. The housing of the power supply module is designed to fit over the existing ballast cover 132 of the existing troffer 130. Once in place, the ballast AC power supply is terminated or disconnected and instead connected to the power supply module 131 of the present invention. Once the power supply module 131 is seated within the light assembly 130, and electronically connected to the AC power supply 135, an LED light source 134 can be used as the light source within the fluorescent troffer. The socket holders 133 on the power supply module are basically in the same location as the socket holders of the fluorescent light tube fixture. It takes roughly only 5 minutes to retrofit a fluorescent light tube troffer with the present invention compared to 20 minutes to retrofit with an LED replacement tube. Stated another way, the installation time of the current retrofit kit may be substantially reduced as compared to other alternatives.

Figure 17:
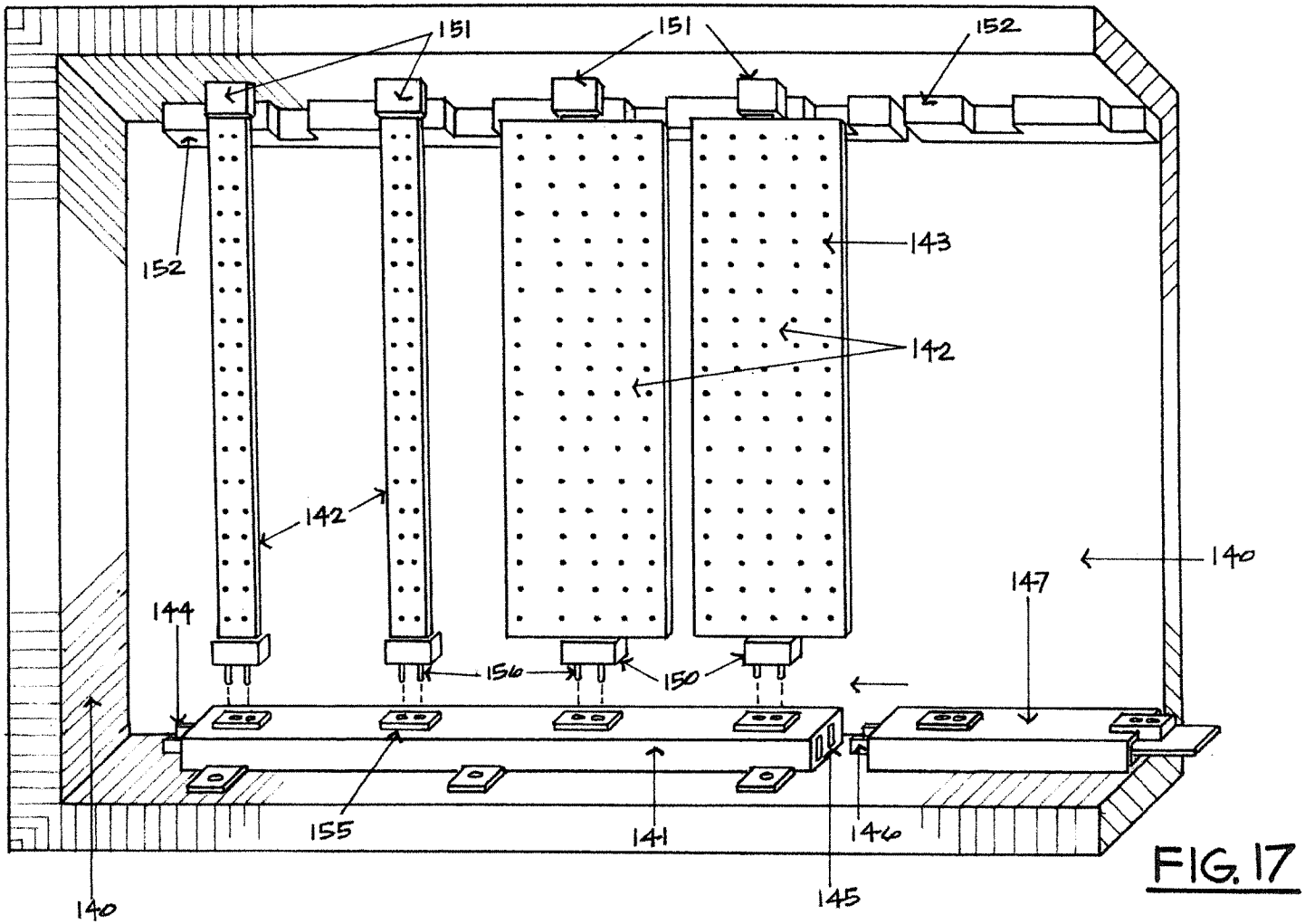
FIG. 17 illustrates yet a fourth embodiment, and a perspective view of a modular power supply installed within a sign box in accordance with the present invention.
Figure 18:
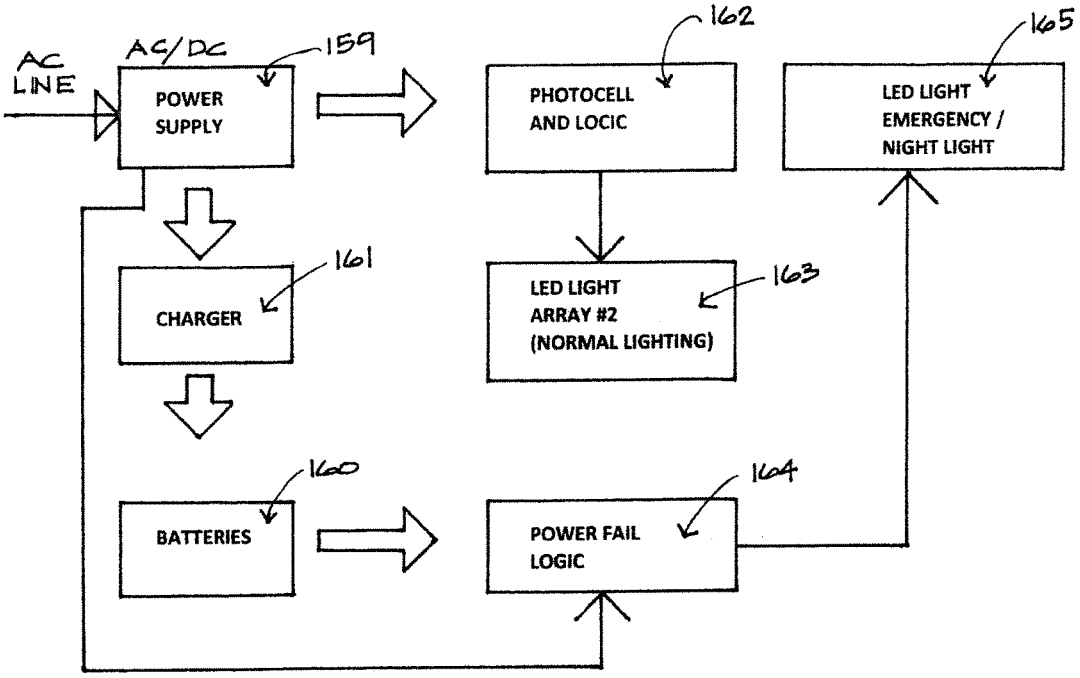
FIG. 18 illustrates a schematic of one embodiment of an LED light assembly in accordance with the present invention.

More and more sign boxes are using LEDs as the light source. FIG. 17 illustrates a sign box 140 comprised of a power supply module 141 mounted at the bottom of the sign box. The power supply module 141 used to operate LEDs 142 within a sign box that is similar to the embodiments of FIG. 1 and FIG. 10. The only difference is that the power supply module has the ability to add additional power supply modules. FIG. 18 illustrates the power supply modules 141 being connected end to end. The first power supply module 141 is connected at a first end 141*a* to an AC power source 144. A receptacle 145 is located on the opposite or second end 141*b* of the first power supply module 141 and functions to connect a second power supply module 147 to first power supply module 141. A plug 146 is positioned at a first end 147*a* of the second power supply module 147 and mates with receptacle 145 for connecting the second power supply module 147 to the first power supply module 141. The second power supply module 147 may also contain a receptacle (not shown) at the opposite end for adding a third power supply module (not shown) if needed. A rack 152 is positioned at an end opposite the power supply module 141. Retaining elements 151 are contained within the rack for receipt of a non-conductive end of a corresponding light unit 142, whereby the light units 142 are thereby fixed in a vertical position. Conductive end caps 150 are positioned at a first end of each light unit 142 and contain prongs 156 for receipt of DC energy. As explained below, receptacles 155 on power module 141 provide DC power to the light units 142 once a corresponding pair of prongs 156 are seated within each pair of receptacles 155.

FIG. 17 also illustrates another LED light source in the form of an LED light panel 142. Located at one end of each LED light panel is an end cap 150 similar to that of a LED light tube in FIG. 2 as the means to connect and receive DC power to operate the LED light panel 142. At the opposite end of the LED light panel is a support cap 151 that connects to a special support bracket 152 that is mounted to the housing of the sign box 140. The end cap 151 simply snaps into the support bracket 152 keeping the LED light panel from falling out. The amount of time to install the present invention within a sign box is ⅓ the time of installing a fluorescent light tube system. FIG. 17 further illustrates the power supply module containing one or more socket holders 155 as the means to connect and deliver DC power to one sided or two sided LED light tubes 142. The two sided LED light source, essentially containing LED lights on each side of the device 142, is designed to direct light in opposing directions. The two sided signs are normally found along the road, and the current embodiment illustrated in FIG. 17 finds advantage where both sides of the signs require illumination at night. Using the present invention over the traditional fluorescent light tubes will result in less cost to maintain. In view of the fact that most exterior two sided signs operate all night, the present invention of using a DC powered LED light source 142 would benefit the owner in savings of energy costs.

An AC/DC power supply/converter is schematically shown in the Block Diagram illustrated in FIG. 18 and is provided to supply direct current power to an LED array. The AC/DC converters used in the present invention may, but not by way of limitation, be provided by V-Infinity of Oregon as identified as part number FSC-S15-15U, for example. It will be appreciated that other sources of alternating current may also be rectified or converted to appropriate amounts of direct current depending on design criteria. For example, 220 VAC could also be rectified to 15 VDC if desired. As also schematically shown in the block diagram of FIG. 18, the AC/DC converter may operably and electronically communicate with battery source 160, a charger 161 and a circuit 162 that detects AC interruption, thereby providing direct current to each. Alternatively, a rectifier may instead be provided rather than the converter, so long as direct current power ultimately is provided in appropriate and operable amounts to the charger 161 and the LED array 163. Charger 161 may electronically or operably communicate with one or more batteries 160 to maintain a charge to the rechargeable batteries 160. In the event of power failure, direct current may be provided by and through a circuitry 162 that detects a power interruption and the absence of alternating current being supplied to the direct current power supply. Accordingly, in the event of power failure, direct current is provided from the batteries 162 to first LED array 163. Also shown in FIG. 18, a power sensor normally communicates with a signal from the power supply, thereby confirming the existence of AC power. In the event of an interruption in power supply, the power sensor switches to battery power from the battery source 160, thereby providing DC power in an emergency situation. The battery current provides power to first LED array 113 thereby providing emergency lighting in the absence of ambient light.

Figure 19:
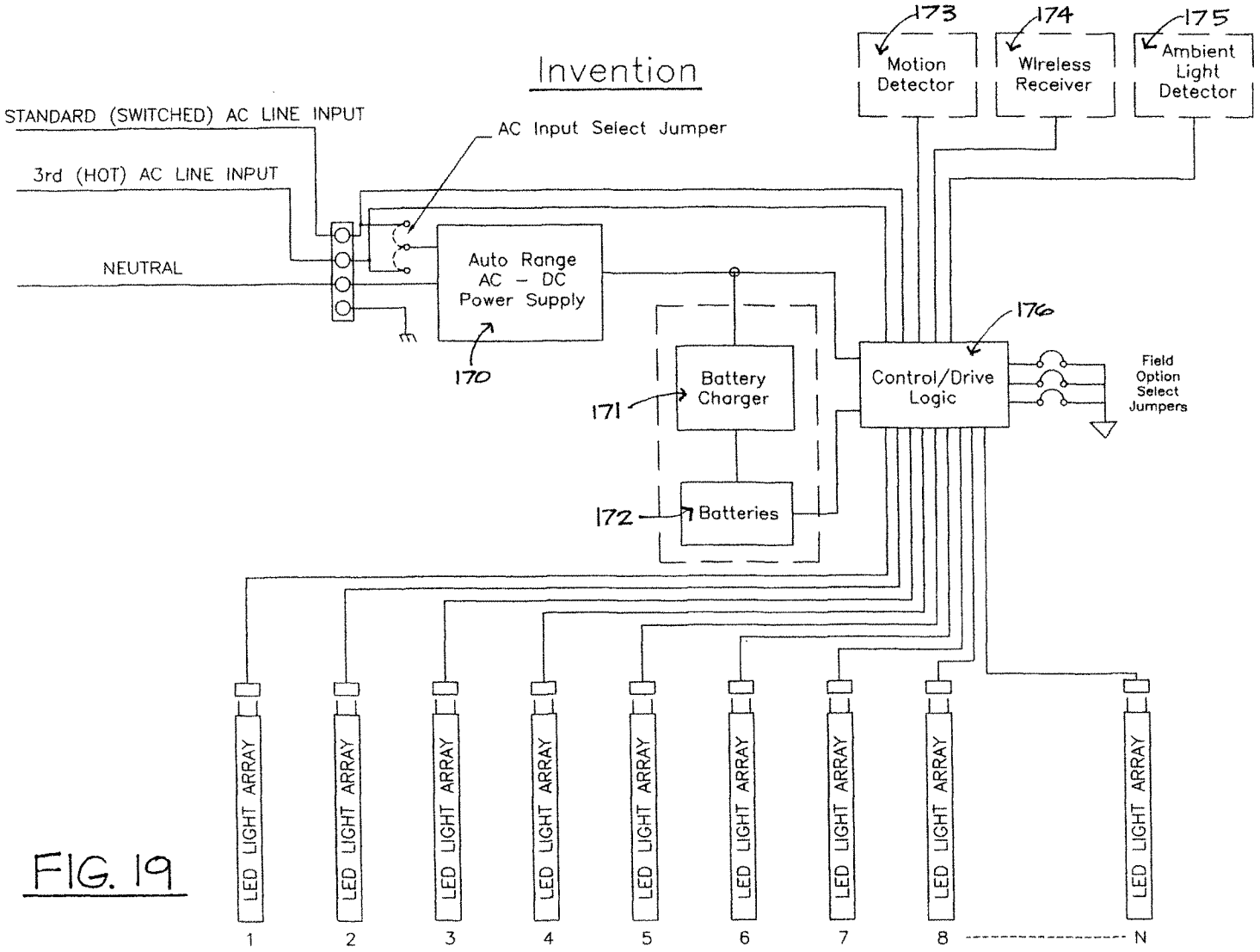
FIG. 19 illustrates a schematic of one embodiment of an LED light assembly in accordance with the present invention.

FIG. 19 illustrates a block drawing diagram of a modular designed system, as shown in FIG. 6 for example, of the present invention. An AC Input Select Jumper indicates that the AC/DC supply can be either connected to the HOT line or the SWITCHED line. In the case where this is no more than a STANDARD LIGHT fixture, the power supply would then be connected to the SWITCHED line. This would be the most energy efficient means of operation. Another option may be that the AC-DC power supply (power supply module) is connected to the HOT line. This would be selected in the case where there are batteries and a battery charger is incorporated as adding an emergency light function to the present invention. This would keep the batteries fully charge at all times and ready to activate the emergency light when power is lost or interrupted. Both AC lines communicate with the Control/Drive Logic. The logic would monitor both lines looking for a power failure. Alternatively, the logic may be programmed by the user to operably dictate the light units desirably lit at selected times. The options of Motion Detector 173, wireless receiver 174, and Ambient Light detector 175 are in a form of a module, and provide the means of simply plugging in one or all options within the present invention. The present invention incorporates field option select jumpers as a way to enable or select one of the options indicated above. If, for example an owner only wants the Ambient Light Detector to turn the lights ON/OFF then one of the jumper selection would enable the field electrician to select only that option. The present invention incorporates a wire or wireless programmable option that allows the owner to select his options by way of jumpers. Three jumpers are illustrated but there could easily be more or they could be dip switches, similar to what is used with a garage door opener, for example. One of ordinary skill in the art will recognize the myriad of ways to actuate the embodiment. Also FIG. 19 illustrates one or more LED light strips connected independently to the Control/Drive Logic to permit the owner to program (though the jumpers) a reduced number of LED light strips for operation as a night light, for example. An auto range AC-DC Power supply is incorporated within the present invention as a universal power supply and the means where the field electrician can connect either 120V or 240V to the respective light assembly. It will be appreciated that the system will essentially function from either one.

The present invention resolves these issues by simplifying the LED fixture/troffer with a power supply module having no wiring within the troffer. The power supply module is powered by an AC power source. The benefit of one or more socket holders mounted directly to a circuit board of the power supply module and installed at one end of the troffer will eliminate having socket holders at both ends of the troffer/fixture. Also the present invention is comprised of an LED light source with one end cap instead of two. Each socket holder is comprised of a positive and negative female connection, providing DC power to an LED light source comprised of only one end cap with a pair of prongs (one positive/one negative) extending outwards as connectors. The cost savings of not incorporating an AC to DC converter as part of the LED light source will result in lower cost and thereby make replacement of the LED light source less expensive to the consumer.

The embodiments may also provide for enhanced dimming control. In one embodiment, dimming is set by setting the light assembly to a predetermine level of light. In another embodiment, the control circuitry is programmed to recognize the repeated switching of a power source as an indication of the level of dimming desired. Another associated algorithm may be configured to receive control information signals and provide control commands to the LEDs. The control unit may be capable of receiving the control signals over a wireless transmission, for example.

The lighting assembly also may include a remote control sensor. Using the remote control sensor, the power supply module may be configured to perform various functions in response to signals received by the remote control sensor. These functions may include disabling at one or more LED light tubes, and/or changing the brightness of one or more LEDs light tubes.

Other variables as recognized in the art, for each constituent described herein, are also contemplated, and the omission of any equivalent should not be construed as limiting the invention to the exemplary embodiments described herein.

In conclusion, the present invention of an LED troffer/fixture provides numerous advantages over the traditional fluorescent light tube troffer. The electrical power requirements for LED lighting are quite low in comparison to most other forms of lighting, thereby saving energy and increasing efficiency in comparison to other lighting forms. Moreover, the present invention eliminates the need for relatively high step-up voltages, as it is not necessary to ionize gases within a tube, as is done in fluorescent lighting. This greatly reduces the potential hazard of such a system, as the voltage required is considerably lower than the conventional supply voltage (i.e., 110 to 115 volts) in most areas. Another most important advantage of the present light assembly is that the elimination of the potential danger of breakage of the glass of the fluorescent light tube. The additional benefit in terms of emergency lighting, which is difficult to achieve using fluorescent lighting, is resolved.

It will be further understood that the foregoing descriptions of various embodiments of the present invention are for illustrative purposes only. As such, the various structural and operational features herein disclosed are susceptible to a number of modifications commensurate with the abilities of one of ordinary skill in the art, none of which departs from the various permutations described herein. For example, various known light assemblies incorporate a wide variety of sockets that differ in design from the light sockets described and shown herein. Nevertheless, it is believed that a subassembly could be provided for any number of differently designed sockets so long as each socket was also fitted in accordance with the present invention. The subassembly or LED assembly would simply be designed to accommodate the architecture of the particular light assembly. Yet another example would be how a light socket assembly may be described as a night light adapter as characterized and described above, or, a light socket assembly may be characterized as a conventional light socket assembly containing a night light configuration as described above and herein.

What is claimed is:

1. A light assembly comprising:

a housing;

one or more LED light units contained within said housing, each of said LED light units containing only one corresponding conductive end cap;

a pair of conductors extending from each of said corresponding conductive end caps; and a first DC power supply module separable from said one or more LED light units and contained within said housing, said first DC power supply module containing one or more female sockets for seating of a corresponding pair of conductors from one of said one or more LED light units.

2. The light assembly of claim 1 wherein said housing contains a first end and a second end, and said DC power supply module is housed at said first end, and said one or more LED light units extend from said first end to said second end.

3. The light assembly of claim 1 wherein said light assembly further comprising:

a support rack fixed within said second end of said housing; and one or more support elements corresponding in number to said one or more LED light units, wherein each of said one or more LED light units extend from said DC power supply module to a corresponding one of said one or more support elements, each of said one or more LED light units removably fixed within a corresponding one of said one or more support elements.

4. The light assembly of claim 2 further comprising:

a sub-housing contained within said housing at said first end, wherein said DC power supply module is removably fixed within said sub-housing.

5. The light assembly of claim 1 further comprising a motion sensor, a light sensor, or a programmable algorithm in electronic communication with said DC power supply module for selectively lighting said one or more LED units upon a predetermined event.

6. The light assembly of claim 1 wherein said one or more LED lighting units are one or more DC-powered LED tubes or LED strips.

7. The light assembly of claim 1 further comprising a second DC power supply module in electronic communication with said first DC power supply module, wherein said second DC power supply module contained within said housing contains one or more female sockets for seating of a corresponding pair of conductors from one of said one or more LED light units.

8. A light assembly comprising:

a housing containing a housing;

a plurality of LED light units contained within said housing, each of said LED light units containing only one corresponding conductive end cap;

a pair of conductors extending from each of said corresponding conductive end caps;

a DC power supply module separable from said plurality of LED light units and contained within said housing, said power supply module containing a plurality of female sockets for seating of a corresponding pair of conductors from one of said plurality of LED light units; and a plurality of drivers electronically communicating with said DC power supply module, each of said plurality of drivers electronically communicating with a corresponding one of said plurality of LED light units, wherein each of said plurality of drivers are operatively independent of one another.

9. The light assembly of claim 8 wherein said plurality of drivers are a plurality of AC/DC converters or a plurality of rectifiers.

10. The light assembly of claim 8 structured as a modular assembly, wherein each of said plurality of LED light units, each of said plurality of drivers, and said DC power supply module are independently removable from said light assembly for replacement or maintenance thereof.

11. A light assembly comprising:

a housing;

one or more LED light units contained within said housing, each of said LED light units containing only one corresponding conductive end cap;

a pair of conductors extending from each of said corresponding conductive end caps; and one or more DC power supply modules separable from said one or more LED light units and contained within said housing, each of said DC power supply modules containing one or more female sockets for seating of a corresponding pair of conductors from one of said one or more LED light units.

* * * * *